United States Patent [19]

Kita

[11] Patent Number: 4,770,081

[45] Date of Patent: Sep. 13, 1988

[54] SERVOMECHANISM WITH IDLE GEAR FEEDBACK

[75] Inventor: Yasuo Kita, Kyoto, Japan

[73] Assignee: Shimadzu Corporation, Kyoto, Japan

[21] Appl. No.: 921,089

[22] Filed: Oct. 21, 1986

[51] Int. Cl.[4] ..... F15B 9/12; F15B 13/16; F15B 9/03

[52] U.S. Cl. ..... 91/1; 91/362; 91/363 R; 91/381; 417/498; 137/625.65

[58] Field of Search ..... 91/363 R, 381, 1, 36, 91/380, 362; 417/472, 498; 137/625.65

[56] References Cited

U.S. PATENT DOCUMENTS

| | | | |
|---|---|---|---|
| 1,119,324 | 12/1914 | Sprater | 91/381 X |
| 1,563,282 | 11/1925 | Jessup | 91/381 X |
| 2,874,542 | 2/1959 | Tear | 91/381 X |
| 2,915,034 | 12/1959 | Russell | 91/381 X |
| 2,974,641 | 3/1961 | Brown et al. | 91/381 |
| 4,161,905 | 7/1979 | Ota | 91/381 X |
| 4,235,156 | 11/1980 | Olsen | 91/363 R |
| 4,526,342 | 7/1985 | Wakefield | 137/625.65 |

FOREIGN PATENT DOCUMENTS

| | | | |
|---|---|---|---|
| 943801 | 12/1946 | France | 91/381 |
| 261827 | 12/1928 | Italy | 91/381 |

*Primary Examiner*—Robert E. Garrett
*Assistant Examiner*—Mark A. Williamson
*Attorney, Agent, or Firm*—Armstrong, Nikaido, Marmelstein & Kubovcik

[57] ABSTRACT

A servomechnism made up of a relatively small number of components has a pintle that is moved back and forth by a hydraulic actuator, an input member disposed opposite to the pintle and capable of reciprocating parallel with the pintle, a spool capable of reciprocating parallel to both the input member and the pintle, a pair of idle gears pivoted to the spool, and a hydraulic circuit. The input member has a rack opposite to a rack formed on the pintle. The spool is mounted between these racks. The idle gears are in mesh with the racks. When the input member is moved to shift the spool out of its neutral position, the actuator is unlocked to return the spool to its neutral position.

3 Claims, 4 Drawing Sheets

64
51
55
54
63
57
52
81
58
56
34
19
14a
14c
58
24
14b
61
22
35
38
39
28
29
21
25
2c
2a
42a
7a
9
7b
42b
11
3
7c
5
42c
4
23
27
26
37
36
4
5
7a
9
3
7b
11
7c
8
2
13
16
14
12
41
6
1

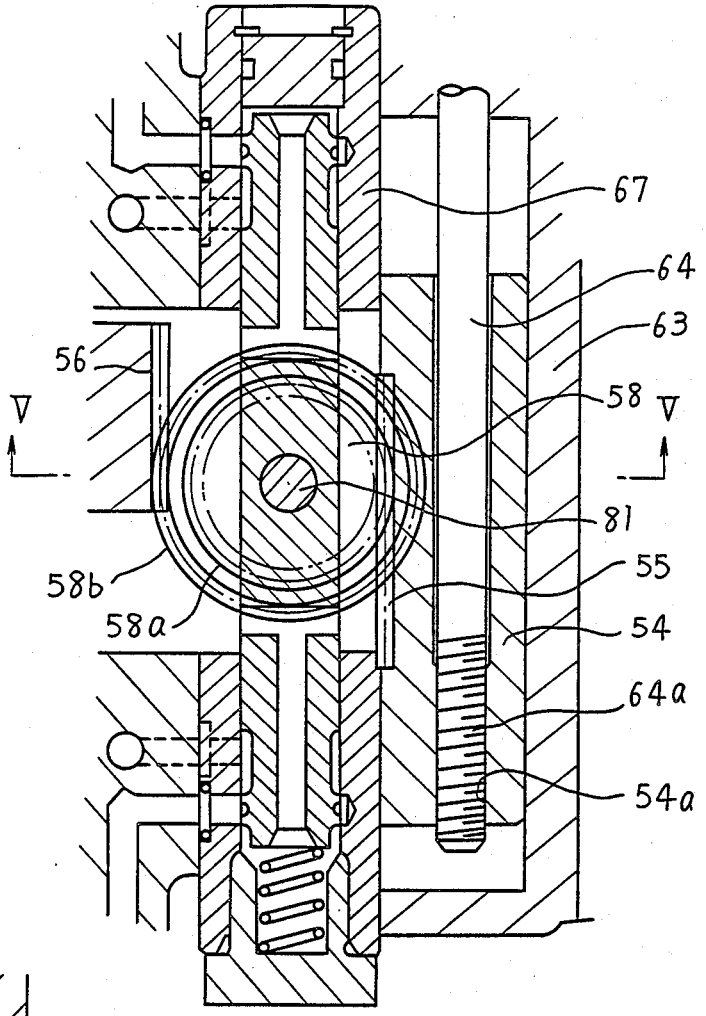
Fig. 5
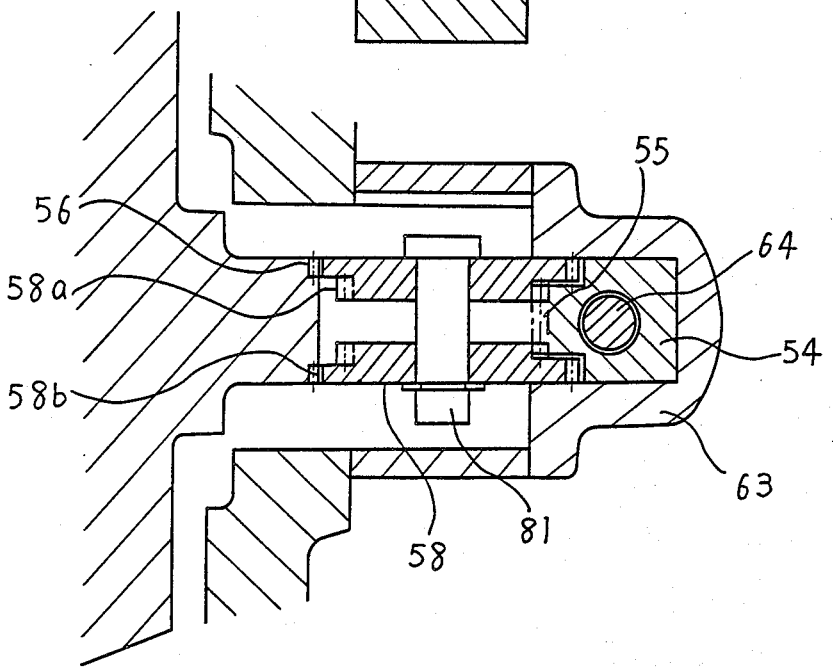

SERVOMECHANISM WITH IDLE GEAR FEEDBACK

FIELD OF THE INVENTION

The present invention relates to a servomechanism which augments a displacing input applied to an input member to produce a larger output corresponding to the amount of displacement and which is proportional to the input.

BACKGROUND OF THE INVENTION

A servomechanism of this kind has its output member actuated by a hydraulic actuator or the like. A change-over valve is mounted in the circuit for driving the actuator so that a displacing input applied to the input member may control the valve. The displacing output from the output member is fed back to the valve such that the position of the valve body of the change-over valve can be adjusted. In this way, the aforementioned augmented output can be produced which is proportional to the input.

In this prior art mechanism, the output displacement from the output member is fed back to the change-over valve by means of a linkage or the like. Therefore, the mechanism is made up of a large number of components and hence complex in structure. Further, such a structure is difficult to assemble. Also, it is difficult to make such a mechanism small and lightweight.

SUMMARY OF THE INVENTION

In view of the foregoing, it is an object of the present invention to provide a servomechanism which is made up of a relatively small number of components, is not difficult to assemble, is small in size and lightweight, and has a high reliability.

It is another object of the invention to provide a servomechanism which has the advantage in that it can readily operate accurately, in addition to the features described in the above paragraph.

These objects are achieved by a servomechanism comprising: an output member capable of reciprocating in certain directions; an actuator for reciprocating the output member by utilizing hydraulic pressure; an input member which is disposed opposite to the output member and which is reciprocated in a direction parallel to the output member by receiving an operation input; racks formed on the opposite portions of the input and output members, respectively; a spool disposed between the racks of the input and output members and capable of reciprocating in a direction parallel to the input and output members; idle gears provided to the spool and meshing with the racks; and a hydraulic circuit which, when the spool is in its neutral position, locks the actuator and which, when the input member is moved to shift the spool out of its neutral position, acts to unlock the actuator so that the spool may be returned to its neutral position.

The object described secondly is achieved by a further provision of a spring that resiliently presses the spool in a certain direction.

In this structure, in such a condition when the spool is held in its neutral position and the actuator is locked, if the input member operates, one of the idle gears is caused to roll on the rack of the output member. Then, the spool moves a certain distance proportional to the moving distance of the input member, in the same direction as the input member. As a result, the hydraulic circuit is changed over to another condition to operate the actuator so that the output member is moved in such a direction so as to return the spool to its neutral position. Eventually, the spool remains substantially stationary. Therefore, the output member moves a distance proportional to the moving distance of the input member invariably in the reverse direction to the input member.

BRIEF DESCRIPTION OF THE DRAWINGS

FIG. 4 is a cross-sectional view of another embodiment of the instant invention; and FIG. 5 is a cross-sectional view taken on line V—V of FIG. 4.

DETAILED DESCRIPTION OF THE INVENTION

Figure 1:
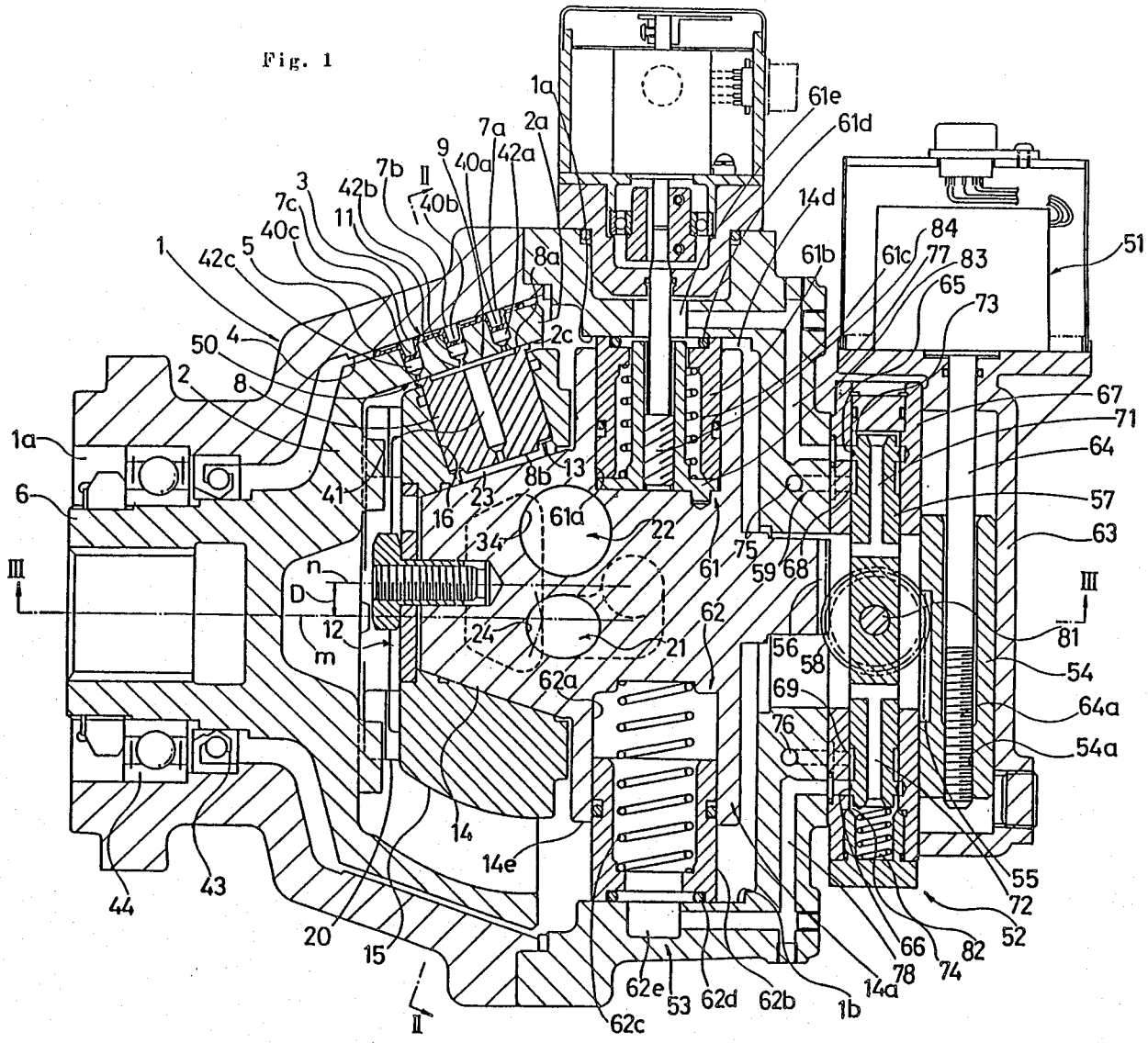
FIG. 1 is a cross-sectional view of a first embodiment of the instant invention.
Figure 2:
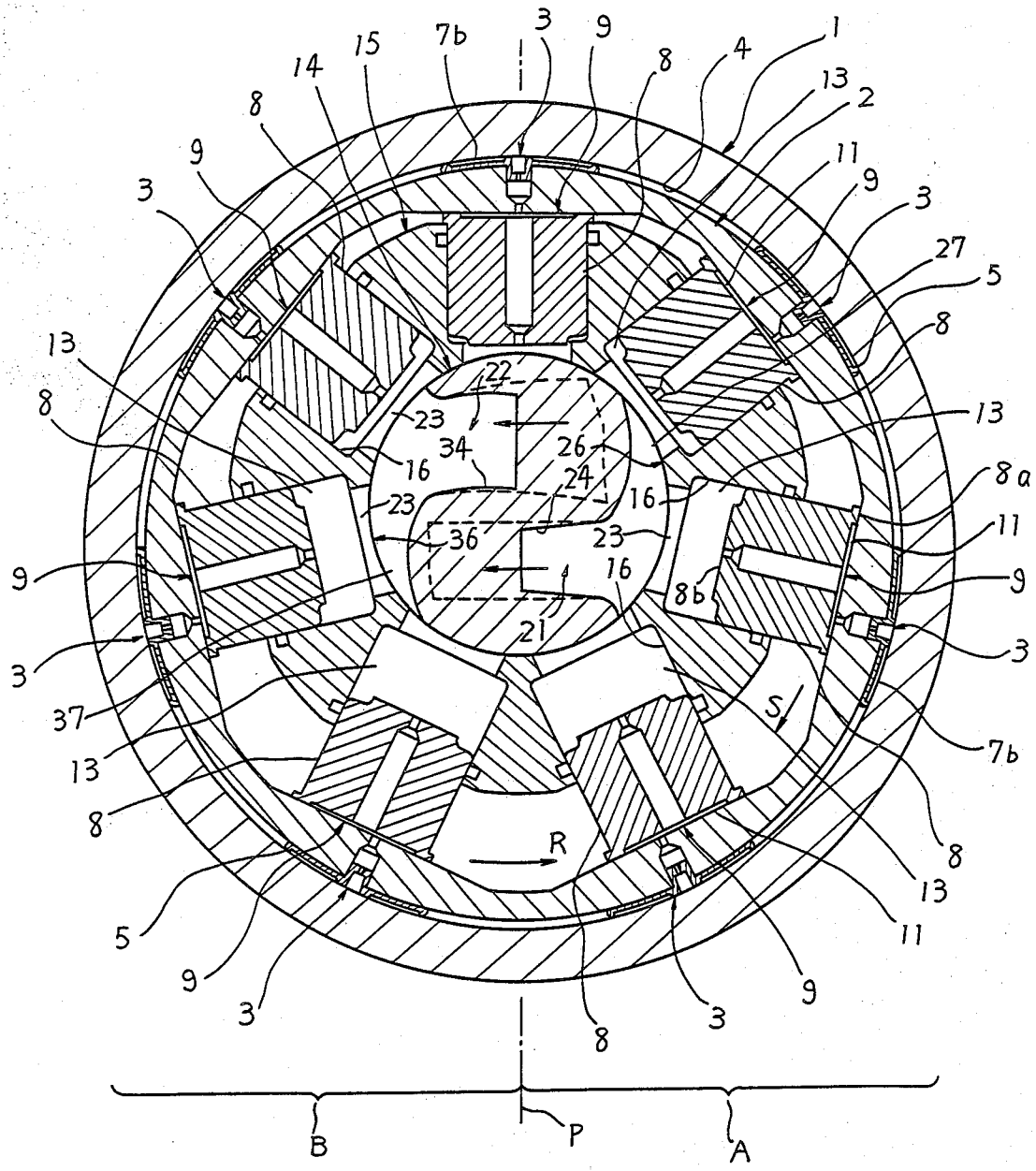
FIG. 2 is a cross-sectional view taken on line II—II of FIG. 1.
Figure 3:
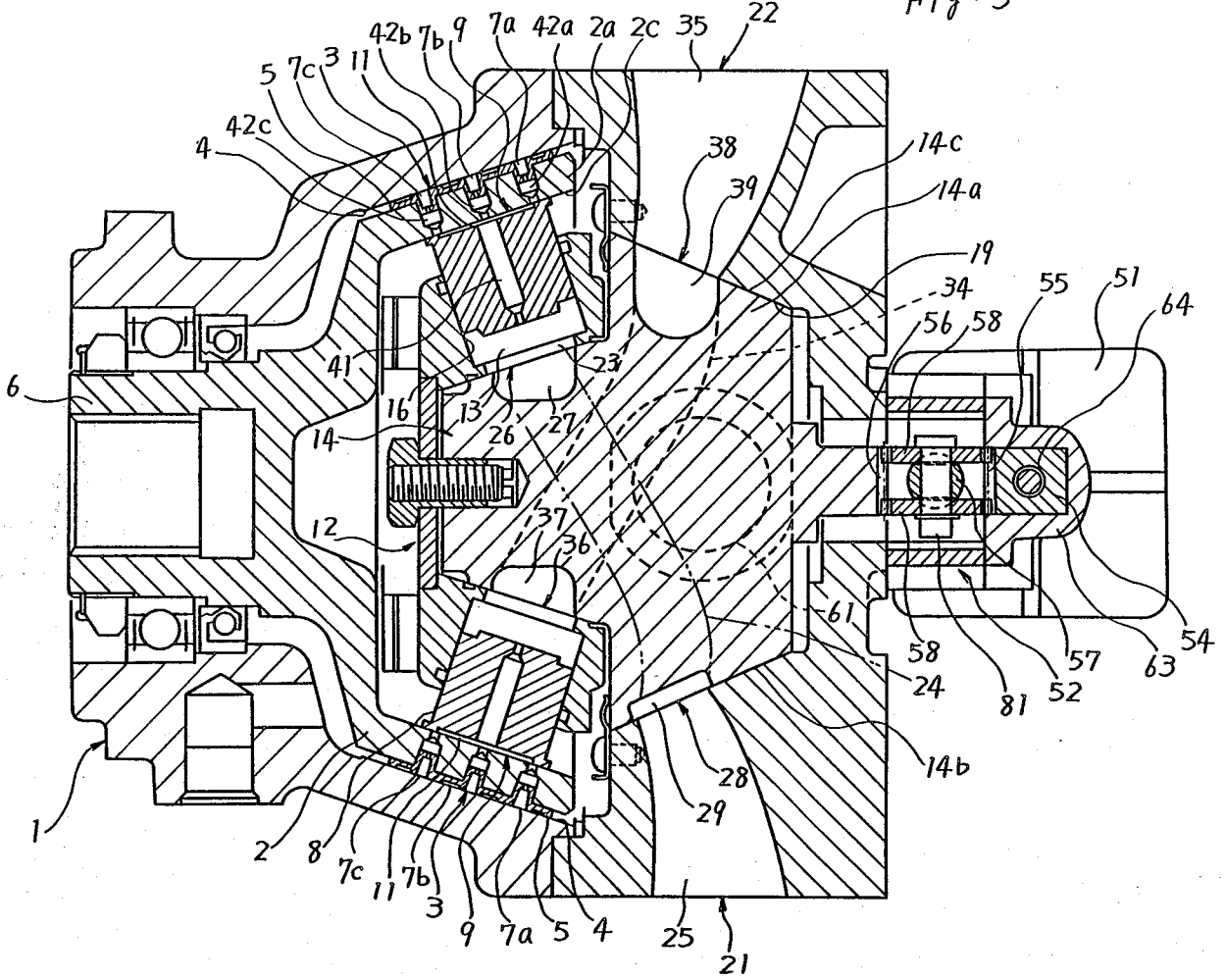
FIG. 3 is a cross-sectional view taken on line III—III of FIG. 1.

Referring to FIGS. 1–3, there is shown a rotary fluid energy converter. A servomechanism according to the invention is used to adjust the position of the pintle of this converter as described later. The converter has a cylindrical housing 1 having a bottom, and a torque ring 2 which is rotatably and snugly mounted on the inner surface of the housing 1 by means of first static pressure bearings 3. The housing 1 is provided with an opening 1*a* at one end thereof. The inner surface of the housing has a surface 4 tapering toward opening 1*a*, and the ring 2 is in contact with this tapering surface 4. The ring 2 is shaped like a cup and has a peripheral wall 2*a* that forms the same taper angle as the tapering surface 4. A rotating shaft 6 is formed integrally with the ring 2 and protrudes from one axial end thereof. The front end portion of the shaft 6 extends outwardly from the housing 1 through the opening 1*a*. The first bearings 3 rigidly fix shoes 5 to the outer surface of the ring 2 at required positions, each shoe 5 being pressed on the tapering surface 4 of the housing 1. Each shoe 5 is provided with three pressure pockets 7*a*, 7*b*, 7*c* axially adjacent one another. Hydraulic pressure is introduced into the pockets 7*a*, 7*b*, 7*c*. The odd number of bearings 3 are regularly and circumferentially spaced apart from one another. The inner surface of the torque ring 2 has flat surfaces 2*c* at positions corresponding to the bearings 3.

Pistons 8 are disposed at positions corresponding to the inner flat surfaces 2*c*. The front ends 8*a* of the pistons 8 are pressed against their corresponding surfaces 2*c* by means of second static pressure bearings 9. The bearings 9 are made planar so that the front ends 8*a* of the pistons 8 may come into close contact with their corresponding surfaces 2*c*. Each front end 8*a* has a pressure pocket 11 into which hydraulic pressure is introduced. The base end of each piston 8 is held by a piston retainer 12. A space 13 is formed between the retainer 12 and the piston 8 for accepting fluid therein.

The piston retainer 12 consists of a pintle 14 having a sliding portion 14*a* together with an annular cylinder barrel 15. The sliding portion 14*a* is supported on the housing 1. The pintle 14 rotates about an axis n that is parallel to the axis m about which the housing 1 and the torque ring 2 rotate. The barrel 15 is rotatably fitted over the outer periphery of the pintle 14. The barrel 15 is provided with a plurality of cylinders 16 which are regularly and circumferentially spaced apart from one another and are arranged radially. The axis of each cylinder 16 is substantially perpendicular to the outer surface of the pintle 14. The pistons 8 are fitted in cylinders 16 so as to be slidable therein. The base surface **8*b* of each piston 8 of the inner surface of each cylinder 16 form the space 13. The barrel 15 is connected to the torque ring 2 by means of an Oldham coupling 20 or similar part, so that the barrel can rotate at the same angular velocity as the ring 2**.

The pintle 14 takes the form of a truncated cone whose outer surface has a taper angle substantially equal to the taper angle formed by the peripheral wall **2*a* of the ring 2. The pistons 8 are so positioned that they move perpendicularly to the peripheral wall 2*a* of the ring 2. The sliding portion 14*a* of the pintle 14 is shaped in the form of a block of a longitudinally elongated dimension, and is trapezoidal in cross section. The sliding portion 14*a* is slidably fitted in a trapezoidal groove 19 formed in the housing 1. That is, the pintle 14 is held in such a way that it can slide perpendicularly to the axis m. This makes it possible to set the distance D between the axis n of the pintle 14** and the axis m to any desired value, including zero.

As shown in FIG. 2, the inside of the housing 1 is divided into a first region A and a second region B by an imaginary line P that is drawn in the direction in which the pintle 14 slides. Those spaces 13 which are moving across the first region A are placed in communication with a first fluid communication line 21, and spaces 13 which are moving across the second region B are made to communicate with a second fluid communication line 22.

The first fluid communication 21 has fluid passages 23, a port 24 extending through the pintle 14, and a fluid inlet/outlet port 25 formed in the housing 1, corresponding to one end of the port 24. The spaces 13 are in communication with the inside of the barrel 15 via the passages 23. One end of the port 24 extends to the outer periphery of the pintle 14 on the side of the first region A, while the other end extends to the inclined surface **14*b* of the sliding portion 14*a* of the pintle 14 that is on the side of the second region B. A pressure pocket 27 is formed between the outer periphery of the pintle 14 and the inner surface of the cylinder barrel 15, at one end of the port 24, in order to form a third static pressure bearing 26. Another pressure pocket 29 is formed between the inclined surface 14*b* of the pintle 14 and the inner surface of the housing 1, at the other end of the port 24, to form a fourth static pressure bearing 28. The pocket 27 is elongated circumferentially, and acts to place all spaces 13 existing in the first region A in communication with the port 24 extending through the pintle. The pocket 29 is elongated in such a direction that the pintle 14 slides. When the pintle 14 is caused to slide, the pocket 29 prevents the port 24 from being disconnected from the fluid inlet/outlet port 25**.

The second fluid communication line 22 has fluid passages 23, a port 34 extending through the pintle, and a fluid inlet/outlet port 35 formed in the housing 1 at a position corresponding to one end of the port 34. The other end of the port 34 extends to the outer surface of the pintle 14 on the side of the second region B, while the other end extends to the inclined surface **14*c* of the sliding portion 14*a* of the pintle on the side of the first region A. At the other end of the port 34, a pressure pocket 37 is formed between the pintle 14 and the cylinder barrel 15 to form another third static pressure bearing 36. At the one end of the port 34, a further pressure pocket 39 is formed between the inclined surface 14*c* of the pintle and the inner surface of the housing 1 to form another fourth static pressure bearing 38. The pockets 37 and 39 are similar in structure to pockets 27 and 29**.

A pressure inlet passage 41 is formed along the axis of each piston 8. The fluid pressure within each space 13 corresponding to each piston 8 is introduced into the pressure pocket 11 in the corresponding second static pressure bearing 9 via the pressure inlet passage 41. The hydraulic pressure within the pocket 11 is directed into the pressure pockets **7*a*, 7*b* and 7*c* in the corresponding first static pressure bearing 3 via fluid passages 42*a*, 42*b*, and 42*c* formed in the ring 2. These passages 42*a*, 42*b* and 42*c* and the pressure pockets 11 constitute slide valve elements 50, which act to selectively cut off the flow into the pockets 7*a*, 7*b* and 7*c*, making use of the axial movement of the piston 8 relative to the torque ring 2. When the axial distance between the center of the position of each first static pressure bearing 3 and the center of the piston 8 is within a certain limit, the pressure pockets 11 are in communication with all the fluid passages 42*a*, 42*b* and 42*c*, However, when the distance exceeds the limit, the pockets 11 come out of communication with the fluid passages 42*c* or 42*a* which is farther from the piston 8. Restrictors 40*a*, 40*b* and 40*c* are mounted in the passages 42*a*, 42*b* and 42*c***, respectively.

The directions and area of the static pressure bearings 3 and 9 are set to such a value that the force acting on the torque ring 2 due to the static pressure of the fluid introduced into the first bearings 3 is identical in magnitude but opposite in direction to the force acting on the torque ring 2 due to the static pressure introduced into the second bearings 9. The area of the second bearings 9 is set to such a value that the force acting on the piston 8 due to the static pressure applied to the bearing 9 is cancelled by the force working on the piston 8 due to the static pressure of the fluid within the spaces 13. Further, the area of the third static pressure bearings 26 and 36 is set to such a value that the force acting on the barrel 15 due to the static pressure introduced into the bearings 26 and 36 is cancelled by the force acting on the barrel 15 due to the static pressure of the fluid within the spaces 13 that exist in the corresponding regions A and B. The angle at which the surface **14*b* and 14*c* are inclined is set to such a value that the force acting on the pintle 14 due to the static pressure of the fluid introduced to the bearings 28 and 38 is cancelled by the force acting on the pintle 14 due to the static pressure of the fluid introduced to the third bearings 26 and 36 existing in the regions A and B in opposite relation to the inclined surfaces 14*b* and 14*c* on which the bearings 28 and 38 are respectively mounted. Seal members 43 as well as an assistant bearing 44 are provided for supporting rotating shaft 6**.

The fluid energy converter of the variable displacement type constructed as described above further includes a stepping motor 51 for converting electrical digital signals into a mechanical displacement and the servomechanism 52 for reciprocating the pintle 14 in proportion to the output displacement delivered from the motor 51. The servomechanism 52 is comprised of the pintle 14 capable of reciprocating in certain directions and acting as the output member, an actuator 53 for reciprocating the pintle 14 by utilizing hydraulic pressure, an input member 54 that is disposed opposite pintle 14 and is reciprocated in a direction parallel to the pintle 14 by receiving the operation input, racks 55 and 56 are formed on the opposite portions of the input member 54 and pintle 14, respectively, a spool 57 disposed between the racks 55 and 56 and capable of reciprocating in a direction parallel to the input member 54, idle gears 58 pivoted to the spool 57 and meshing with the racks 55 and 56, and a hydraulic circuit 59, which when the spool 57 is in its neutral position, locks the actuator 53 and which, when the spool 57 is moved out of its neutral position by movement of the input member 54, acts to unlock the actuator 53 so that the spool 57 may be returned to its neutral position.

More specifically, the actuator 53 consists mainly of a pair of hydraulic cylinders 61, 62 disposed at the longitudinal ends of the sliding portion 14*a* of the pintle 14. The cylinders 61 and 62 comprise cylindrical pistons 61*b* and 62*b*, respectively, slidably fitted in holes 61*a* and 62*a* formed in end surfaces 14*d* and 14*e*, respectively, of the sliding portion 14*a* of the pintle 14. Springs 61*c* and 62*c* are mounted in holes 61*a* and 62*a*, respectively, to bias the pistons 61*b* and 62*b*, respectively, outwardly. The outer ends of the pistons 61*b* and 62*b* are always pressed against the inner surfaces 1*a* and 1*b* of the housing 1 via seal members 61*d* and 62*d*, respectively. Entrance/exit ports 61*e* and 62*e* communicating with the holes 61*a* and 62*a* are formed in the inner surfaces 1*a* and 1*b*, respectively, of the housing 1.

The input member 54 is square rod and is slidably received in a cover 63 which has a U-shape in cross section. The member 54 has a threaded hole 54*a* extending along its axis, so that the member 54 is screwed to a threaded portion 64*a* formed on the output shaft 64 of the motor 51.

The spool 57 has lands 65 and 66 near its ends. Both ends of the spool 57 are slidably fitted in a port block 67 disposed between the housing 1 and the cover 63. The block 67 and the spool 57 form high-pressure passages 68 and 69 on the inner side of the lands 65 and 66 and low-pressure passages 73 and 74 on the outside of the lands 65 and 66, which communicate with a case drain via ports 71 and 72. High-pressure ports 75 and 76 which are always in communication with the high-pressure passages 68 and 69 are opened in the inner surface of the block 67. Ports 77 and 78 communicate with the ports 61*e* and 62*e* in the cylinders 61 and 62, respectively. The servomechanism is set so that when the spool 57 is held in its neutral position, the lands 65 and 66 close the ports 77 and 78, respectively. A flat portion is formed at the center of the spool 57. Two idle gears 58 are rotatably mounted at opposite sides of the flat portion by means of pin shafts 81. A spring 82 is mounted between the lower end of the spool 57 and the inner surface of the port block 67 to resiliently press the spool 57 upwardly at all times. The hydraulic circuit 59 is constructed of the pressure ports 75, 76, the high-pressure passages 68, 69, the entrance/exit ports 77, 78, the low-pressure passages 73, 74, and return ports 71, 72. The pressure ports 75 and 76 are in communication with the fluid communication line on the higher-pressure side, the first fluid communication line 21 in the embodiment.

The operation of the illustrated mechanism will now be described. The body of the mechanism essentially operates in the manner as described in Japanese Patent Laid-Open No. 77179/1983. Specifically, when high-pressure fluid is supplied into the spaces 13 existing in the first region A through the first fluid communication line 21, a couple of forces that rotates the torque ring 2 in the direction indicated by arrow S is produced. Thus, the system functions as a motor. When the ring 2 is rotated in the direction indicated by arrow R by an external force, high-pressure fluid is discharged from the first fluid communication line 21. Thus, the system functions as a pump. The pintle 14 is reciprocated along the trapezoidal groove 19 to vary the eccentricity, i.e., the distance between the axis n of the pintle and the axis m of the housing 1. Thereby, the displacement can be controlled.

The mechanism which controls the variable displacement operates in the manner described below. When the stepping motor 51 is at a halt and the spool 57 is maintained at its neutral position as shown in FIG. 1, the lands 65 and 66 on the spool 57 close the ports 77 and 78. Therefore, the hydraulic cylinders 61 and 62 of the actuator 53 are locked, retaining the pintle 14 at a specific position. Under this condition, the stepping motor 51 is operated by an instruction from a computer (not shown). When the output shaft 64 rotates through a given angle, the input member 54 of the servomechanism 52 screwed to the threaded portion 64*a* of the shaft 64 moves in a direction parallel to the direction in which the pintle 14 operates.

When the input member 54 moves upward from the location shown in FIG. 1, the idle gear 58, meshing with the rack 55 of the member 54, rolls upwardly on the rack 56 of the pintle 14 that is stationary. Then, the spool 57 that is connected to the center of this gear 58 by means of the pin shaft 81 moves upwardly a distance half of the moving distance of the input member 54. The pressure port 75 is in communication with the entrance/exit port 77 via the high-pressure passage 68. As a result, a portion of the high-pressure fluid in the first fluid communication line 21 is supplied into the entrance/exit port 61*e* of one cylinder 61 by way of the ports 75 and 77. The pressure fluid is then introduced into the cylinder hole 61*a*. At this time, the other port 78 communicates with the return port 72 via the other low-pressure passage 74. The pressure of the pressure fluid supplied into the one cylinder 61 moves the pintle 14 downward. Then, the idle gear 58 downwardly rolls on the rack 55 of the input member 54, shifting the spool 57 downwardly until it returns to its neutral position. In this state, the entrance/exit ports 77 and 78 are again closed by the lands 65 and 66 and the cylinders 61 and 62 are locked again. Accordingly, the pintle 14 moves the same distance as the moving distance of the input member in the reverse direction, and then it comes to a halt.

When the input member 54 moves downward, a similar situation applies but in a reverse manner. That is, the pintle 14 moves upwardly the same distance as the moving distance of the input member 54. In this way, as the motor 51 is rotated forward or rearward, the pintle 14 moves the corresponding distance in the corresponding direction. The displacement can be appropriately changed in response to the digital signal supplied to the stepping motor 51.

The servomechanism 52 has the idle gears 58 mounted between the input member 54 and the pintle 14 that acts as the output member. By the rolling movement of the gears 58, the input displacement is transmitted from the input member 54 to the spool 57, and the displacement fed back is transmitted from the pintle 14 to the spool 57. Hence, the servomechanism is made up of many fewer components and is simpler in structure than the mechanism using a linkage or the like. Therefore, the novel servomechanism can be made much smaller and lighter in weight than the conventional servomechanism. Also, since the spool 57 is invariably resiliently biased in a certain direction by the spring 82, the idle gears 58 are always resiliently brought into mesh with the racks 55 and 56. Thus, the gears 58 are prevented from rattling on the racks 55 and 56. That is, the mechanism is unaffected by backlash. This allows fine adjustment and accurate control for access to a desired position.

In the illustrated embodiment, the distance moved by the output member is equal to the amount of displacement of the input member, but various modifications and changes may be made thereto. For example, as shown in FIGS. 4 and 5, idle gears have different radii may be used in a pair, in which case the output member can be moved a distance porportional to the input displacement. The distance may be increased or decreased, depending on the combination of racks and gears. In the embodiment shown in FIGS. 4 and 5, an idle gear **58*b* is in mesh with the rack 56, and a smaller idle gear 58*a* is in mesh with the rack 55**.

In another feature of the invention, the pintle 14 can be moved a distance forward or rearward, depending on the direction of the rotation of the motor, the distance corresponding to the angle through which the stepping motor 51 rotates. This makes it possible to appropriately vary the displacement in response to the digital signal supplied to the motor 51. Therefore, when the stepping motor is operated according to a signal from a digital control apparatus, such as a computer, constant-pressure operation, constant-horsepower operation, or two-pressure control can be easily and accurately performed. Further, the system can readily accommodate itself to changing a control mode. Furthermore, since the stepping motor operates directly on a digital signal from a computer or the like, no digital-to-analog converter circuit is needed. In addition, as the system is not affected by drift due to temperature variations or other phenomenon, there is no need for various compensators or similar circuits. Consequently, the novel mechanism is characterized in that it is simple in structure, yet can perform accurate variable-displacement operation, as defined in the appended claims.

In another feature of the invention, the displacement can be appropriately varied in response to a digital signal fed to the stepping motor 51. The amount of change is converted into a digital signal by an encoder, and can be presented on a display unit for external inspection. Therefore, for detecting the output, since the threaded rod 84 is screwed to the nut 83 disposed in the cylinder of the actuator 53 and is connected with the encoder, the mechanism for transmitting the signal indicative of the position of the operating pintle 14 to the encoder is not bulky, thus contributing to simplification of the structure. Additionally, since the nut 83 is always pressed against the pintle 14 by the spring **61*c* in the actuator 53, it is possible to cause the nut 83 to accurately follow the operation of the pintle 14 without the need to use a special fixing element for rigidly fixing the nut to the pintle 14. Consequently, the position of the operating pintle 14 can be detected with high accuracy without introducing various difficulties, including the difficulty with which the mechanism is assembled or manufactured and the complexity of the structure. Hydraulic pressure may be employed to urge the nut toward the pintle. In this case, it is necessary to seal the lower side of the nut 83** and to place the interior thereof in communication with the drain. The present invention is also characterized in this respect as defined in the appended claims.

It is to be noted that the invention is not limited to the control over the position of the pintle, but rather it may be used in various other applications.

Since the novel servomechanism is constructed as described thus far, it does not suffer from the disadvantage that it is made of a large number of components, making the structure complex. Therefore, it is easy to make small and lightweight. Further, the servomechanism operates reliably.

The servomechanism has the advantage that accurate control can be performed, in addition to the aforementioned advantages.

I claim:

1. A servomechanism comprising:

an output member capable of reciprocating in predetermined directions;

an actuator having opposing hydraulic cylinders for reciprocating the output member in response to hydraulic pressure supplied to one of said cylinders;

an input member which is disposed opposite to the output member and which is reciprocated in a direction parallel to the output member by receiving an operation input;

racks formed on the opposite portions of the input and output members, respectively;

a spool disposed between the racks of the input and output members and being capable of reciprocating in a direction parallel to the input and output members;

biasing means for biasing said spool in a first direction;

idle gears mounted on a central portion of said spool and meshing with the racks; and a hydraulic circuit including fluid switching means disposed at both ends of said spool, for locking the actuator in position when the spool is in its neutral position, and for unlocking the actuator, when the input member is moved to shift the spool out of its neutral position, so that the spool may thus be returned to its neutral position.

2. A servomechanism as set forth in claim 1, further including a stepping motor for converting electrical digital signals into mechanical displacement and a means moving in a proportion to the output displacement from the motor, for applying the operation input to the input member.

3. A servomechanism as set forth in claim 1, further including a nut always pressed against the output member reciprocated by the hydraulic actuator, a threaded rod screwed to the nut and acting to convert the movement of the nut following the output member into rotary reciprocating movement, and a means connected to the threaded rod and acting to convert the rotary displacement of the rod into an output indicative of the displacement of the output member.

* * * * *